United States Patent [19]

Simon et al.

[11] Patent Number: 4,754,894

[45] Date of Patent: Jul. 5, 1988

[54] WASTE CONTAINER

[75] Inventors: Ernest M. Simon, Weston, Conn.; Robert B. Balfantz, Bethesda, Ohio; Robert R. Dyson, Pleasant Valley, N.Y.

[73] Assignee: Centre Foundry & Machine Co., Wheeling, W. Va.

[21] Appl. No.: 48,050

[22] Filed: May 11, 1987

[51] Int. Cl.[4] ..... B65D 51/18

[52] U.S. Cl. ..... 220/256; 376/272; 250/506.1

[58] Field of Search ..... 220/256; 250/506.1; 376/272

[56] References Cited

U.S. PATENT DOCUMENTS

| | | | |
|---|---|---|---|
| 4,569,818 | 2/1986 | Popp et al. | 376/272 |
| 4,582,668 | 4/1986 | Mallory et al. | 376/203 |
| 4,594,214 | 6/1986 | Popp et al. | 376/272 |
| 4,626,402 | 12/1986 | Baatz et al. | 376/272 |
| 4,673,813 | 6/1987 | Sanchez | 250/506.1 |

OTHER PUBLICATIONS

Brochure entitled "Centre Foundry Introduces the New Heavyweight Champ".

*Primary Examiner*—George T. Hall

*Attorney, Agent, or Firm*—Merchant, Gould, Smith, Edell, Welter & Schmidt

[57] ABSTRACT

A container is disclosed having a first massive container element with side walls and bottom wall defining a first interior. The first massive container has an opening exposing the first interior. A second massive container element is provided with side walls and bottom walls cooperating to define a second interior. The second massive container element is disposed within the interior of the first massive container element with exterior walls of the second container element abutting interior walls of the first container element. A first cap is sized to cover the opening of the first container element. A second cap is provided and sized to pass through the opening of the first container element and cover the opening of the second container element. Drive pins are provided through axially aligned holes to fasten the first cap to the first container element and simultaneously urge the second cap into sealing engagement with the second container element.

7 Claims, 1 Drawing Sheet

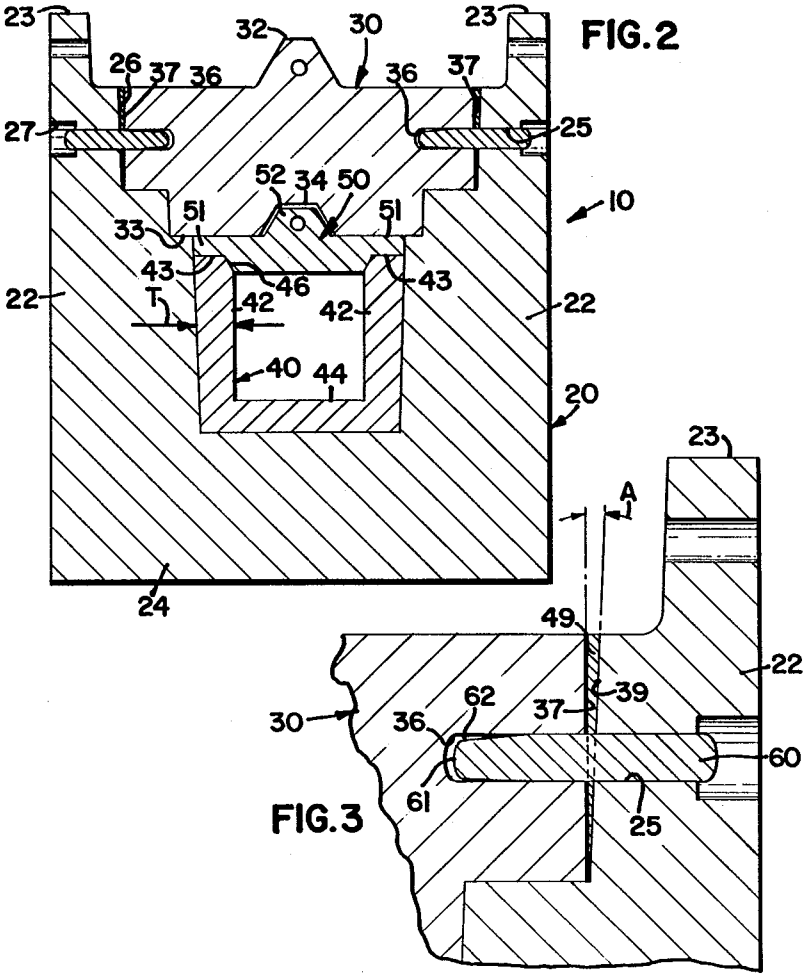
FIG. 2
FIG. 3
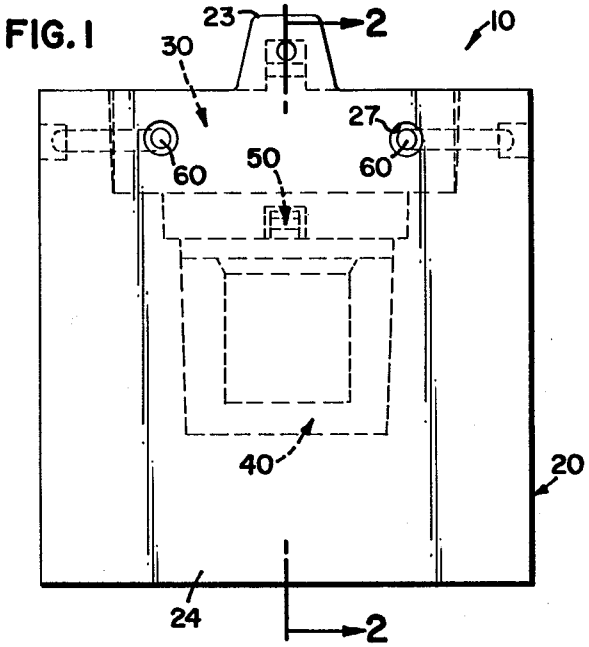
FIG. 1

WASTE CONTAINER

BACKGROUND OF THE INVENTION

I. Field of the Invention

This invention pertains to a container and, more particularly, to a container for transporting and storing waste materials.

II. Description of the Prior Art

The transportation and storage of nuclear waste materials presents serious environmental and public safety concerns. Such containers must be able to contain hazardous materials and prevent radiation as well as be durable to avoid damage during transportation. It is also desireable to make the containers as easy to manufacture as possible.

We have determined that an adequate container can be manufactured utilizing conventional founding equipment. The founding industry is currently experiencing an economic slow down. As a result, there is a high availability of conventional molds and plant capacity. We have determined that this capacity could be utilized by designing a highly durable container fabricated through conventional founding techniques.

SUMMARY OF THE INVENTION

According to a preferred embodiment of the present invention, a container is disclosed having a first massive container element with walls defining an interior of predetermined dimensions. A second massive container having a defined interior is disposed within the first interior with outer surfaces of the second container abutting inner surfaces of the first container. A cap is provided and sized to pass through the opening of the first container and cover the opening of the second container. Another cap is provided sized to cover the first container opening. Means are provided for attaching the first cap to the first container element with the first cap positioned covering the opening. The first cap urges the second cap against the second container in tight sealing engagement as the first cap is attached to the first container.

BRIEF DESCRIPTION OF THE DRAWINGS

FIG. 1 is a side view taken in elevation of a container according to the present invention;

FIG. 2 is a cross-sectional view of the container taken along lines 2—2 of FIG. 1; and FIG. 3 is an enlarged view of the container of the present invention showing a drive pin locking arrangement.

DETAILED DESCRIPTION OF THE PREFERRED EMBODIMENT

Referring now to the several figures in which identical elements are numbered identically throughout, a container according to the present invention is generally shown at 10. The container 10 includes first and second container elements 20 and 40, respectively.

First container element 20 is a massive container element which is preferably formed of cast iron in the shape of a cube. In a preferred embodiment where the container 10 is to be used for containing and transporting nuclear wastes, container element 20 is a cube having an edge length of about ten feet. Container element 20 includes side walls 22 and bottom wall 24 which are integrally cast together and have interior surfaces defining a first interior of container element 20. The top portion of container element 20 has an opening 26 which exposes the interior of container element 20. Side walls 22 are provided with lifting lugs 23.

Second container element 40 is also formed of side walls 42 and an integrally cast bottom wall 44. In a preferred embodiment, the interior of container element 20 is generally cubic in shape and the exterior of container element 40 is also cubic in shape. The exterior surface is sized for second container element 40 to be snugly received in and abut the interior surfaces of container element 20. Preferably, container element 40 is formed of cast lead and is also massive to have a wall thickness T of about eight inches. Like container element 20, container element 40 has an opening 46 which exposes its interior when opening 26 is exposed.

A first cap 30 is provided to cover opening 26. A second cap 50 is provided for covering opening 46.

Second cap 50 is preferably formed of cast lead and has a flange periphery 51 sized to abut free ends 43 of side walls 42. Cap 50 has in integrally cast lifting lug 52 centrally disposed on cap 50.

First cap 30 is preferably formed of cast iron and has a centrally positioned lifting lug 32. The bottom surface 33 of first cap 30 is generally flat and is provided with a centrally disposed recess 34 sized to receive lifting lug 32 when cap 30 is disposed upon cap 50 as shown in the drawings.

Side walls 22 of first container element 20 are provided with bores 25 extending therethrough and in communication with opening 26. On the exterior surfaces of side walls 22, the bores have enlarged diameter portions 27. Cap 30 is provided with a plurality of bores 36 extending inwardly from its side walls 37. Bores 36 are disposed to be in communication with bores 25 when the cap 30 is placed within container element 20 closing opening 26 and resting on cap 50.

A plurality of steel pins 60 are provided each having diameters sized to be snugly received within bores 25 and 36. Steel pins 60 include leading end 61 having an upper ramp surface 62. Pins 60 are inserted by placing the pin 60 through bore 25 and into an aligned bore 36. Preferably, when cap 30 rests on cap 50, bores 36 and 25 are not accurately aligned. Instead, bore 36 is slightly higher than bore 25 with bore 36 exposed through bore 25 an amount sufficient to receive leading end 61 of pin 60. The pin 60 is driven into bore 36 with the ramp edge 62 urging the cap 30 to move downwardly.

In use, second container element 40 is received within first container element 20 with caps 30 and 50 removed thereby exposing openings 26 and 46. Material to be transported and stored is received within the interior or container element 40. Cap 50 is installed by attaching any suitable lifting means to lifting lug 52 and lifting cap 50 and passing cap 50 through opening 26 and resting the cap 50 on free ends 43 of side walls 42. Cap 30 is installed by attaching any suitable lifting means to lug 32 and lifting cap 30 and installing it within opening 26 with the bottom surface 51 of the cap 30 resting on the upper surface of cap 50. Pins 60 are installed through bores 25 and 36 and driven into the depth of bores 26 with the pins 60 forcing bores 36 to accurately align with bore 25. While bores 36 are aligning with bores 25, cap 30 is moving downwardly and compressing cap 50 onto side walls 42. The general deformability of the lead of cap 50 and side walls 42 compared to the rigidity of the cast iron of cap 30 causes a tight seal between the cap 50 and the side walls 42.

After the pins 60 are driven home, a lead seal 39 is provided. As shown best in FIG. 3, the outer surfaces 37 of cap 30 are generally vertical. The opposing surfaces 39 of side walls 22 are not vertical but are inclined outwardly such that surface 39 and surface 37 cooperate to define a lesser included angle A. The space between surfaces 37 and 39 is filled with molten lead which solidifies to form an air-tight seal 49. So sealed, the container 10 may be lifted by attaching any suitable lifting means to lugs 23 and the container 10 may be placed onto a flat-bed or similar transportation vehicle.

The container 10 of the present invention has many advantages. The container may be made with readily available material and casting technology for iron and lead is well developed. The container is self sealing in that the massive cast iron cap 30 urges the lead cap 50 into sealing engagement with side walls 42 as pins 60 are driven home aligning bores 36 and 25. In addition to being deforming and self-sealing, the lead second container 40 provides a completely lead enclosed interior which is desireable for transportation of nuclear waste. This desireability is further enhanced by the massive size of the container 20 of the present invention formed of cast iron.

From the foregoing detailed description of the present invention, it has been shown how the objects of the invention have been attained in a preferred manner. However, modifications and equivalents of the disclosed concepts such as those which readily occur to those skilled in the art are intended to be included in the scope of the invention. Thus, the scope of the invention is intended to be limited only by the scope of the claims as are, or may hereafter be, appended hereto.

We claim:

1. A container comprising:

a first massive container element having side walls and a bottom wall cooperating to define a first interior of predetermined dimensions, said first massive container element having a first opening exposing said first interior;

a second massive container element having side walls and a bottom wall cooperating to define a second interior, said second massive container element having a second opening exposing said second interior, exterior surfaces of said second massive container element shaped for said second container element to be received within said first interior with said second opening exposed through said first opening and with exterior surfaces of said second container element abutting interior surfaces of said first container element;

a first cap sized to cover said first opening;

a second cap sized to pass through said first opening and further sized to cover said second opening;

means for attaching said first cap to said first container element with said first cap positioned covering said first opening; and means for urging said second cap against said second container element and covering said second opening when said first cap is attached to said first container element.

2. A container according to claim 1 wherein said second container element is deformable and is deformed upon insertion of said first cap to form a seal between said second cap and said second container element.

3. A container comprising:

a first massive container element having side walls and a bottom wall cooperating to define a first interior of predetermined dimensions, said first massive container element having a first opening exposing said first interior;

a second massive container element having side walls and a bottom wall cooperating to define a second interior, said second massive container element having a second opening exposing said second interior, exterior surfaces of said second massive container element shaped for said second container element to be received within said first interior with said second opening exposed to said first opening and with exterior surfaces of said second container element abutting interior surfaces of said first container element;

a first cap sized to cover said first opening;

a second cap sized to pass through said first opening and further sized to cover said second opening, said second cap having handle means extending from said cap;

said first cap conformed to have an inner surface resting on said second cap with said inner surface having a recess sized to receive said handle means;

a plurality of bores extending through side walls of said first container element and in communication with said first opening;

said first cap having a plurality of bores extending partially through side walls of said first cap and disposed to be partially axially aligned with said bores through said side wall of said first container element when said cap is disposed within said first opening; and drive pins sized to be received through said aligned openings having diameters sized to urge said first cap into said first opening and accurately align said bores of said cap with said bores of said side walls as said pins are driven into said bores.

4. A container according to claim 3 wherein said drive pins have ramp surfaces on leading ends thereof.

5. A container according to claim 3 wherein said first container element is formed of cast iron.

6. A container according to claim 5 wherein said second container element and said second cap are formed of cast lead.

7. A container according to claim 6 wherein said first cap and said side walls of said first container element have spaced apart opposing surfaces, seal means disposed within a volume defined by said spaced apart opposing surfaces and sealing said volume.

* * * * *